US005553600A

United States Patent [19]

Miller

[11] Patent Number: 5,553,600

[45] Date of Patent: Sep. 10, 1996

[54] CABLE GUARD SLIDE

[76] Inventor: Allen W. Miller, 32 Champagne Dr., Lake St. Louis, Mo. 63367

[21] Appl. No.: 312,136

[22] Filed: Sep. 26, 1994

[51] Int. Cl.[6] ..... F41B 5/10

[52] U.S. Cl. ..... 124/86; 124/25.6

[58] Field of Search ..... 124/23.1, 24.1, 124/25.6, 86, 88

[56] References Cited

U.S. PATENT DOCUMENTS

| | | | |
|---|---|---|---|
| 4,452,222 | 6/1984 | Quartino et al. | 124/88 X |
| 4,596,228 | 6/1986 | Smith . | |
| 4,886,038 | 12/1989 | Betters | 124/88 X |
| 4,917,070 | 4/1990 | Townsend | 124/88 X |
| 4,919,108 | 4/1990 | Larson | 124/88 |
| 5,161,514 | 11/1992 | Cary | 124/24.1 |
| 5,331,941 | 7/1994 | Schaffer | 124/86 X |
| 5,390,654 | 2/1995 | Perkins | 124/24.1 |
| 5,392,757 | 2/1995 | Head et al. | 124/86 |
| 5,415,149 | 5/1995 | Derus et al. | 124/23.1 |

*Primary Examiner*—John A. Ricci

*Attorney, Agent, or Firm*—Polster, Lieder, Woodruff & Lucchesi

[57] ABSTRACT

A cable guard for a compound bow has a rod attached at one end to the bow handle, extending therefrom beyond the cables of the bow when the bow is fully drawn, and spaced laterally from the bow string sufficiently to avoid any interference therewith. A cable retaining member slidably mounted on the rod is made to hold an intermediate portion of the length of the cables selectively either on the side of the rod contiguous the string or on the side of the rod opposite the string.

15 Claims, 3 Drawing Sheets

CABLE GUARD SLIDE

BACKGROUND OF THE INVENTION

The problem posed by the cables in a compound bow are explained in the background of the invention in U.S. Pat. No. 4,452,222. In that patent, a cable retaining member is provided that holds the cables on the side of a cable guard rod contiguous the bow string. Numerous other cable retaining members are designed to hold the cables on the side of the guard opposite the string. Illustrative such devices are described in U.S. Pat. Nos. 4,886,038, 4,903,678, and 4,917,070, among many others. U.S. Pat. No. 4,596,228, which also contains a rather complete description of the prior art and of the problem of the cable guard, discloses a cable separator which holds one of the two cables on the side contiguous the string, and the other, on the side opposite the string. None of the slides of which Applicant is aware, permits the retention of the cable, s selectively on one side of the guard or the other with respect to the bow string.

One of the objects of this invention is to provide a simple, inexpensive cable guard slide that permits the retention of the cables on either side of the guard with respect to the string.

Another object is to provide such a slide that minimizes friction and noise in sliding along the cable guard.

Other objects will become apparent to those skilled in the art in the light of the following description and accompanying drawing.

SUMMARY OF THE INVENTION

In accordance with this invention, generally stated, in a compound archery bow with a bow string and cables connected to the bow string, and a cable guard rod mounted on the bow, a cable guard slide is provided for slidable mounting on the cable guard rod. The slide has end walls and a front wall extending between the end walls. The end walls have guard-receiving passages through them and the front wall has in it means for pulling the cables toward the guard and positioning the cables between the guard and the bow string, and also means for holding the cables on a side of the guard away from the bow string, whereby the cables can be held selectively on either side of the guard with respect to the bow string. In the preferred embodiment, the slide takes the form of a four-sided, substantially rectangular frame, with end walls having passages through them to accommodate the guard rod, and a front wall on an inside surface of which are channels to receive both cables and positively to restrain them against movement toward the bow string, and on the outside of which are two channels, which serve to hold the cables on the side of the guard rod opposite the bow string. In this embodiment, a back wall has a slit through it, parallel with the channels in the front walk through which the cables can be passed to seat in the channels before the slide is mounted on the rod.

Further, in the preferred embodiment, the passage through the end walls, through which the rod extends are, when the rod is circular in cross section, polygonal, in the embodiment illustrated, hexagonal, so as to provide line contact between the rod and the walls defining the passage. In this embodiment, the passages are defined not only by edges defining the passage in the end wall, but at least in part by inside surfaces of the front and back walls, to provide bearing surfaces through the reach of the rod between the outside surfaces of the end walls.

If the rod is made polygonal, the passage can be made circular in plan.

It can be seen that with the arrangement in which the channels on the inside surface of the front wall are used to hold the cables on the side of the rod contiguous the bow string, the cables are held positively, so that they cannot be displaced toward the string, even if a cable should jump upon release of the bow string, for example.

In another embodiment, the slide is made in two segments, which can move along the rod independently, but together serve the function of the single slide of the first embodiment.

In still another embodiment, two parts of the slide are made to hold the cables at two different distances from the rod.

IN THE DRAWINGS

Figure 1:
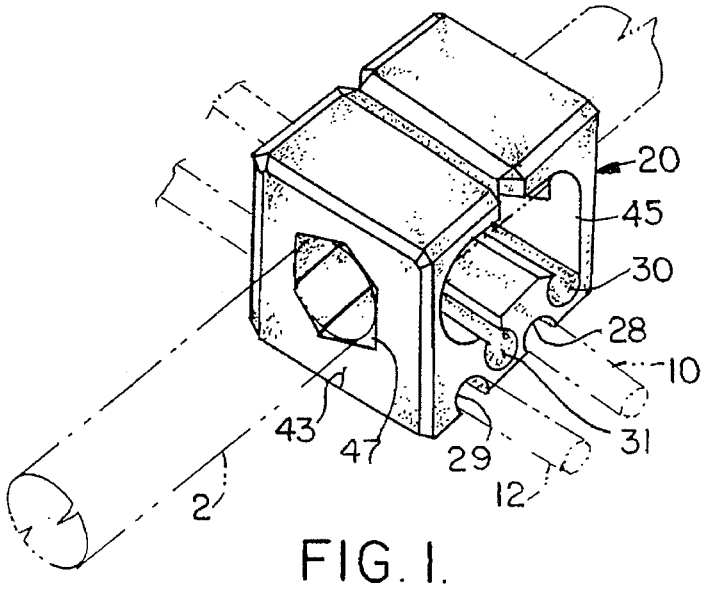
FIG. 1 is a view in perspective of one illustrative embodiment of post guard slide of this invention.
Figure 2:
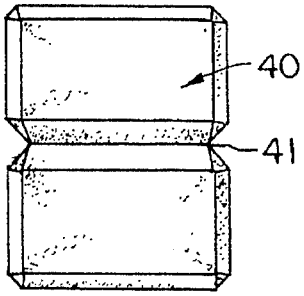
FIG. 2 is a view in top elevation as viewed in FIG. 1.
Figure 3:
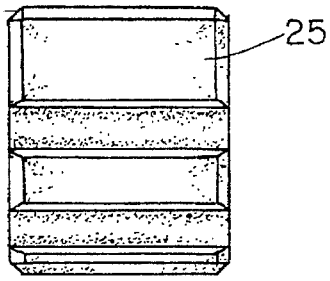
FIG. 3 is a view in bottom elevation.
Figure 4:
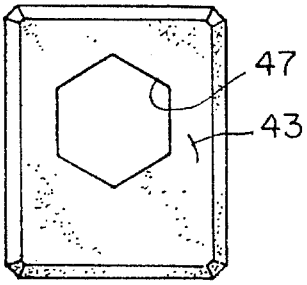
FIG. 4 is a view in end elevation.
Figure 5:
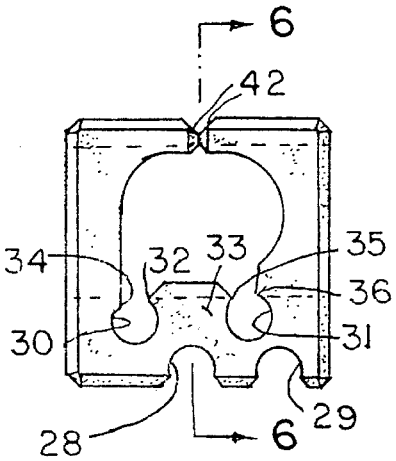
FIG. 5 is a view in side elevation.
Figure 6:
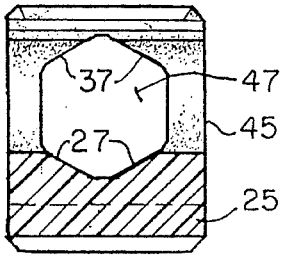
FIG. 6 is a sectional view taken along the line 6—6 of FIG. 5.
Figure 7:
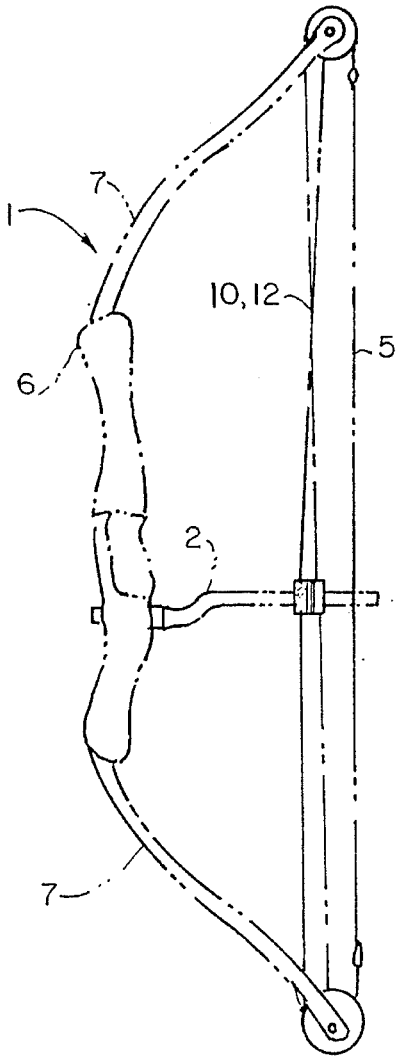
FIG. 7 is a view in side elevation, partly in phantom lines, of a bow equipped with one embodiment of slide of this invention.
Figure 8A:
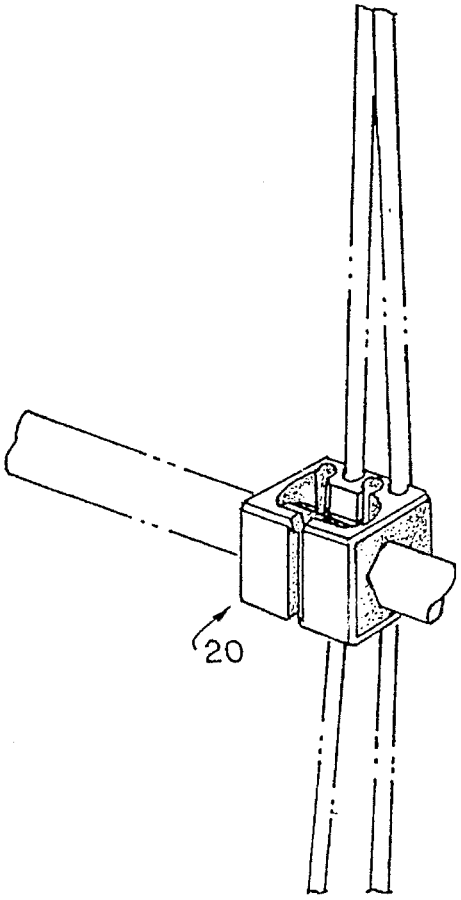
Figure 8B:
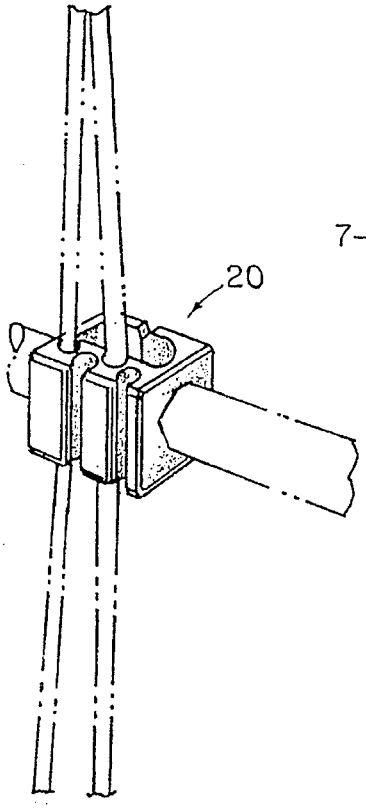
Figure 9:
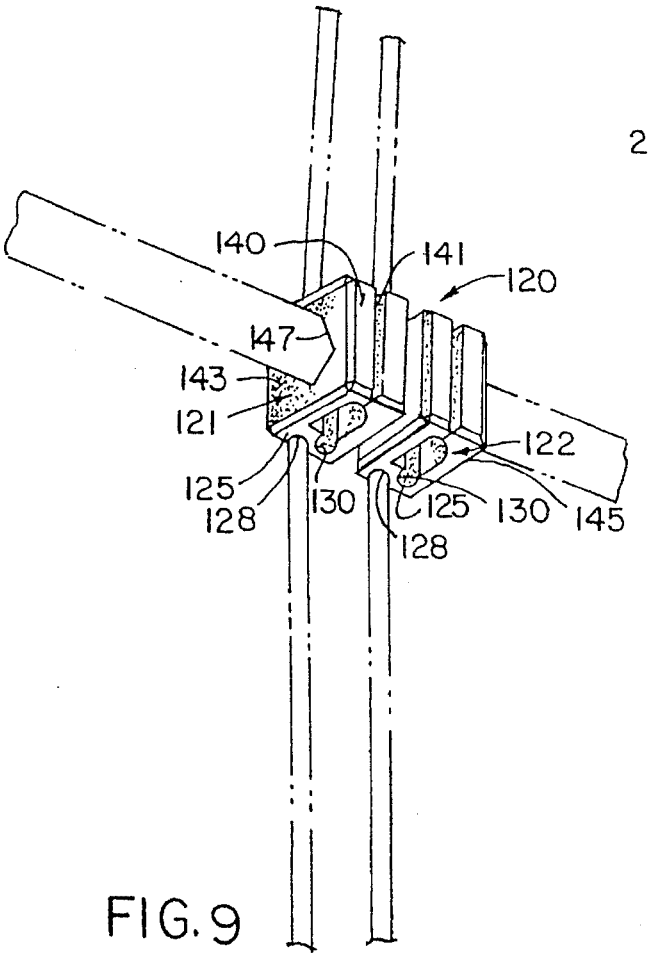
Figure 10:
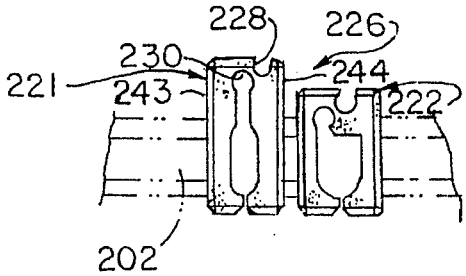
Figure 11:
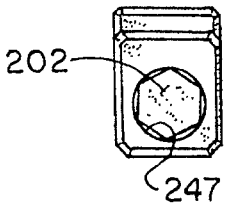
Figure 12:
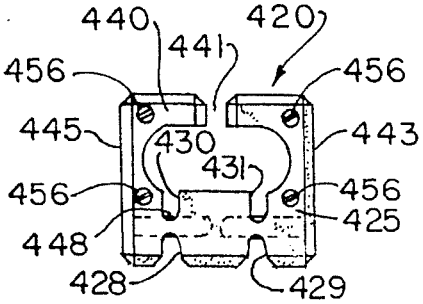
Figure 13:
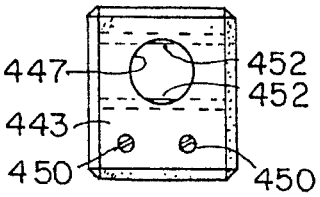
Figure 14:
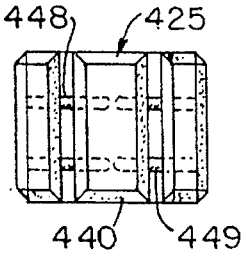
Figure 15:
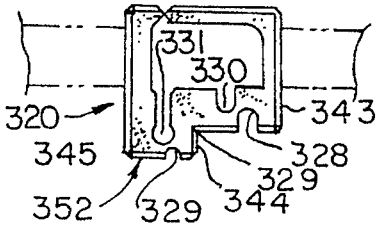

FIG. 8*a* is a view in perspective of one embodiment of slide of this invention mounted on a guide rod and restraining cables, shown in phantom lines, on a side of the guide rod adjacent a bow string;

FIG. 8*b* is a view in perspective of the slide of FIG. 8*a* restraining cables on the side of the guide rod opposite the bow string;

FIG. 9 is a view in perspective of another embodiment of slide of this invention mounted on a guide rod and restraining cables on the side of the rod opposite the bow string;

FIG. 10 is a view in side elevation of still another embodiment of slide of this invention FIG. 11 is an view in end elevation of the embodiment of slide and rod shown in FIG. 10;

FIG. 12 is a view in side elevation of yet another embodiment of slide of this invention;

FIG. 13 is a view in end elevation of the slide shown in FIG. 12;

FIG. 14 is a bottom plan view of the device shown in FIGS. 12 and 13; and FIG. 15 is a view in side elevation of still another embodiment of slide of this invention.

DETAILED DESCRIPTION OF THE DRAWINGS

Referring now to FIGS. 1 through 8 of the drawings for one illustrative embodiment of this invention, reference numeral 1 indicates a compound bow. The bow 1 has the usual bow string 5 and cables 10 and 12, extending over wheels in limbs 7 of the bow extending both directions from a handle 6. A conventional elongated guard rod 2, circular in cross section, is mounted on the handle 6, projecting rearwardly. The rod has an offset or dog-leg section near the handle, and, extending rearwardly from the offset section, a straight reach to a free end.

A slide 20 of this invention is slidably mounted on the straight reach of the rod 2. Hereinafter, when the slide of this invention is referred to as being mounted on the guard or the guard rod, it is to be understood that the slide is mounted on the straight reach of the rod.

The slide 20 in this embodiment is in the form of a four-sided frame, with a front wall 25, a back wall 35, and end walls 43 and 45.

The end walls 43 and 45 have hexagonal passages 47 through them, through which the rod 2 extends. The passages 47 form part of a passage that extends entirely through the slide from the outer surface of the end wall 40 through the outer surface of the end wall 45. The passage is further defined by bearing surfaces 27 of the front wall 25 and bearing surfaces 37 of the rear wall 35. The surfaces 27 and 37 are configured in the same way as corresponding surfaces defining the passages 47 in the end walls 43 and 45, and are aligned with them. The distance between opposing flats of the surfaces defining the passage is sufficient to receive the rod closely but slidably.

The from wall 25 has, opening through an outside surface, channels 28 and 29 to receive the cables 10 and 12. The channels 28 and 29 are oriented perpendicularly to the long axis of the straight reach of the rod 2, parallel to the bow string.

Opening through an inner surface of the front wall 25 are spaced channels 30 and 31, parallel with the channels 28 and 29. The channels 30 and 31 receive the cables 10 and 12 when the cables are to be restrained on the side of the rod between the rod and the bow string 5. The channel 30 has a chamfered lip 32 on a central boss portion 33 forming part of the front wall 25. The lip 32 faces an inside surface of the end wall 40 that is almost tangential to the wall of the channel 30, but off-set inwardly to define a shallow lip 34 parallel with and opposite the lip 32. The channel 31 has lip 35 extending from the boss 33, and a lip 36 opposite it, which is a part of the front wall 25, as shown particularly in FIG. 5. The distance between the lips 32 and 34 and 35 and 36 is slightly less than the diameter of the cables 10 and 12, and the material of which the slide is made is sufficiently resilient to permit the cables to be snapped into place within the channels 30 and 31. The channels themselves are sized to permit the cables to slide in them.

The back wall 40 is divided by slit 41, defined by closely spaced edges of chamfered lips 42. The slit 41 is parallel to the channels 28, 29, 30 and 31. Again, the material of which the slide is made is sufficiently resilient to permit the cables to be forced through the slit 41 between the lips 42, to be seated in the channels 30 and 31. The lips are sufficiently close to keep the end walls substantially parallel when the lips abut, forestalling any cocking of the walls as a result of movement of the outer parts of the end walls toward one another, which is the tendency when the slide is made of stiffly resilient material.

In use, if the cables 10 and 12 are to be restrained on the side of the rod 2 opposite the bow string 5, the slide 20 is mounted on the rod, and the cables 10 and 12 merely brought around the rod with respect to the string and placed in the channels 28 and 29. The force resulting from the lateral displacement of the cables is sufficient to hold the cables in the channels, as in the devices of the prior art. When it is desired to restrain the cables on the side of the rod contiguous the bow string, the cables are snapped through the slit 41, and snapped into the channels 30 and 31, and the slide is then mounted on the guard from the free end of the rod 2, by pulling the cables 10 and 12 rearwardly of the bow until the slide clears the end of the rod. Because in this mode there is less lateral displacement of the cables 10 and 12, there is less force to keep the cables in the slot in the channels, but because the cables are positively restrained, there being no opening through which they can pass, they cannot move toward the string. If there is any jumping of the cables, the lips 32, 34, 35 and 36 restrain the cables from leaving the channels 30 and 31.

Referring now to FIG. 9 for a second embodiment of slide of this invention, the slide 120 is made of two separate components 121 and 122, each a slide in its own right, but together, forming the slide 120. Each of the components 121 and 122 has a front wall 125, with a channel 128 in an outer surface and a channel 130 in an inner surface. Each of the components has a back wall 140, with a slit 141, and end walls 143 and 145 through which hexagonal passages 147 pass. The construction of each of the components 121 and 122 is essentially the same as the slide 20, except for their being individually narrower, and each provided with only one cable receiving channel on either side of the front wall. Collectively they operate as does the slide 20, except that in response to a separation of the cables, they can move apart from one another, either in the movement of the cables during the draw and release of the bow string or in their spacing initially. It can be seen that merely by reversing the components or one of them, the spacing between the channels can be increased or decreased. Thus in the embodiment shown in FIG. 9, if the component 121 is reversed, the channel 128 of that component will be close to the channel 128 in the component 122, whereas if the component 122 is reversed, the channel 128 of that component will be spaced farther from the channel 128 of the component 121. The relative positions of the inner channels 130 can be similarly be changed by reversing one of the components relative to the other.

Referring now to FIG. 10 for yet another embodiment, a slide 220 is made up of two components 221 and 222. The component 222 is identical to the component 122 except for the provision of a passage 247 circular in plan, as shown in FIG. 11. The component 221 is essentially the same, except for the extension of end walls 243 and 244 in a direction away from the rod 202 on which it is mounted. The extension of the end walls 243 and 244 requires that an inner channel 230 be elongated. An outer channel 228 can be substantially the same as the channel 128 of the embodiment shown in FIG. 9. The component 221 is also provided with a passage circular in plan, both components 221 and 222 being slidably mounted on a hexagonal rod 202 as indicated in FIGS. 10 and 11. If the passage through the component 221 is made either hexagonal or is given one flat to correspond with a flat surface of the rod 202, the component 221 can be oriented in one particular direction, if that is desired.

Referring now to FIG. 15, an embodiment of slide is shown that is a combination of the slide 20 and the slide 220 in that it is a one piece slide, but provided with a part that holds one cable at a greater distance from the rod than does another of its parts. In this embodiment, a slide 320 has, as does the slide 20, an outer channel 328 and a parallel outer channel 329, an inner channel 330 and a parallel inner channel 331, all in a front wall 325. However, in this embodiment, the front wall 325 is stepped, with a riser wall 344 matched by an end wall 345 that extends farther from a rod which the slide is mounted than does an end wall 343, so that the front wall is divided into two parts, a nearer part 351 and a farther part 352. As in the case of the slide 320, the channels 329 and 331 hold the cable seated in them at a farther distance from the rod than do the channels 330 and 328. The slide 320 has the virtue of being a one piece slide, but is not quite so versatile as the slide 220, which shares the advantages of the slide 120.

Referring now to FIGS. 12 through 14, for another embodiment, reference 420 indicates a slide that is in effect a deluxe version of the embodiment shown in FIGS. 1 through 8. In the embodiment illustrated, it is shown as having a circular rod-receiving passage, rather than a polygonal one, but that is of no particular significance, as will be explained. The slide 420 is shown as being made of metal. It has a front wall 425, with an outside surface in which are parallel channels 428 and 429, and a back surface in which are channels 430 and 431. The slide 420 has a back wall 440 with a gap 441 in it. The gap 441 is sufficiently wide to admit a cable, because the metal of which the slide is made is not resilient, but has sufficient structural rigidity to keep its shape regardless of forces that are applied to it in its normal use. The slide also has end walls 443 and 445 through which a circularly cylindrical passage 447 extends, as has been indicated. In this embodiment, cable rollers 448 and 449 are journaled in passages through the faces of the end walls 443 and 445, within the thickness of the front wall 425, and are of a diameter such as to extend into the channels 428, 429, 430, and 431, a short distance above their bottoms as shown in FIGS. 12 and 14. The rollers 448 and 449 are first mounted and then are caged against axial dislodgment by cap screws 450. Four rod rollers 452, of which only two are shown, are journaled in passages extending from the front wall 425 through the back wall 440, extending chordally through the passage 447, parallel with one another, as shown in FIG. 13. The rollers 452 are caged against axial dislodgment by cap screws 456, as shown, at the from wall, in FIG. 12. Because the rollers 452 engage the surface of the rod on which the slide is mounted, limiting the amount of contact between the rod and the slide, this embodiment of slide can be used with either a cylindrically round rod or a polygonal one, in the latter case, preferably a polygon with two parallel sides.

Numerous variations in the construction of the slide of this invention will occur to those skilled in the art in the light of the foregoing disclosure. The surfaces defining the passages 47 through the end walls 43 and 45 and the surfaces 27 and 37, lying tangent to the outer cylindrical surface of the rod 2, provide essentially line contacts with the rod. This provides sufficient bearing surface, but practically precludes the interference with the free sliding of the slide by dirt or grime, and, by reducing the area of contact, tends to reduce the amount of noise generated by the slide. A similar result is obtained by making the rod polygonal and the passage cylindrical. As can be appreciated, although a hexagonal form is easily made and works well, other polygonal forms can be used, such as a square or octagon for example. The configuration of the slide itself that has been described is the preferred one, because the back wall 40 provides on its inner surface bearing surfaces that serve a useful function, but the end walls 43 and 45 can be made heavy enough to supply the requisite bearing surface, and the back wall omitted, subject to the requiremtn that the end walls are rigid enough to resist deformation toward one another, as has been explained. Lips can be provided on the channels 28 and 29 if desired. The slide of the preferred embodiment is made of a Nylon type plastic, but other suitable plastics can be used. These are merely illustrative.

I claim:

1. In combination with a compound bow having a handle section and a pair of bow limbs, a bow string and a pair of cables extending between the outer end of the bow limbs in lateral spaced relationship with respect to the plane of the bow and bow string, and a cable guard comprising a rod connected at one end to said handle section and extending therefrom parallel to said plane and in outward spaced relationship with that side of said cables opposite said bow string to a free end beyond said cables when the bow is fully drawn, and a cable retaining member comprising means for slidably mounting said cable retaining member on said rod, and means for holding an intermediate portion of the length of said cables selectively either on the side of said rod contiguous said string or on the side of said rod opposite said string, said means for holding said cables comprising a wall having spaced cable-receiving channels on an inside surface of said wall for holding said cables on a side of said rod contiguous said string and spatted cable-receiving channels on an outside surface of said wall, opening outwardly, for holding said cables on the side of the rod opposite said string.

2. In combination with a compound bow having a handle section and a pair of bow limbs, a bow string and a pair of cables extending between the outer end of the bow limbs in lateral spaced relationship with respect to the plane of the bow and bow string, and a cable guard comprising a rod connected at one end to said handle section and extending therefrom parallel to said plane and in outward spaced relationship with that side of said cables opposite said bow string to a free end beyond said cable when the bow is fully drawn, and a cable retaining member slidably mounted on said rod, said retaining member having means for holding an intermediate portion of the length of said cables selectively either on the side of said rod contiguous said string or on the side of said rod opposite said string, said rod being circular in cross section through the span on which the retaining member is mounted and the retaining member having through it a passage formed by walls defining a polygon, whereby the bearing surfaces of the retaining member on said rod are flat surfaces tangent to an outer surface of said rod.

3. The combination of claim 2 wherein the polygon is a hexagon.

4. In combination with a compound bow having a handle section and a pair of bow limbs, a bow string and a pair of cables extending between the outer end of the bow limbs in lateral spaced relationship with respect to the plane of the bow and bow string, and a cable guard comprising a rod connected at one end to said handle section and extending therefrom parallel to said plane and in outward spaced relationship with that side of said cables opposite said bow string to a free end beyond said cable when the bow is fully dram, and a cable retaining member slidably mounted on said rod, said retaining member having means for holding an intermediate portion of the length of said cables selectively either on the side of said rod contiguous said string or on the side of said rod opposite said string, said rod being polygonal in cross section through the span on which the retaining member is mounted.

5. In combination with a compound bow having a handle section and a pair of bow limbs, a bow string and a pair of cables extending between the outer end of the bow limbs in lateral spaced relationship with respect to the plane of the bow and bow string, and a cable guard comprising a rod connected at one end to said handle section and extending therefrom parallel to said plane and in outward spaced relationship with that side of said cables opposite said bow string to a free end beyond said cable when the bow is fully drawn, and a cable retaining member slidably mounted on said rod, said retaining member having means for holding an intermediate portion of the length of said cables selectively either on the side of said rod contiguous said string or on the side of said rod opposite said string, said retaining means being a hollow rectangle, with a first wall split to permit introduction of said cables and an opposite, second wall having channels open along an inside surface facing said first, split wall, to receive said cables on a side of said rod contiguous said bow string, and channels in said second wall open along an outside surface of said second wall to receive said cables on a side of said rod opposite said bow string.

6. The combination of claim 5 wherein said retaining means has third and fourth walls perpendicular to said first and second walls and provided with rod-receiving passages aligned on an axis perpendicular to said channels, and rolling element bearings extending into said channels to bear against said cables in said channels.

7. The combination of claim 6 including rolling element bearings extending into said rod-receiving passages to bear against said rod.

8. The combination of claim 5 wherein said retaining means has third and fourth walls perpendicular to said first and second walls and provided with rod-receiving passages aligned on an axis perpendicular to said channels, and rolling element bearings extending into said rod-receiving passages to bear against said rod.

9. The combination of claim 5 wherein said second wall has a step in it, one of said channels on an inside surface and one of said channels on an outside surface of a stepped part of said wall being offset in a direction away from said rod from said channels in a part from which the step is offset.

10. In a compound archery bow with a bow string and cables connected to said bow string and a cable guard mounted on said bow, a bow cable guard slide for slidable mounting on said cable guard comprising end walls and a front wall extending between said end walls, said end walls having guard-receiving passages therethrough and said front wall having means comprising first channels in a surface of said front wall adjacent said guard to receive said cables for pulling said cables toward said guard and positioning said cables between said guard and said bow string, and means comprising channels in an exterior surface of said front wall, parallel with said first channels, for holding said cables on a side of said guard away from said bow string, whereby the cables can be held selectively alternatively on either side of said guard with respect to said bow string.

11. The cable guard slide of claim 10 wherein one of the guard and guard-receiving passage is circularly cylindrical, and the other, non-circular.

12. In a compound archery bow with a bow string and cables connected to said bow string and a cable guard mounted on said bow, a bow cable guard slide for slidable mounting on said cable guard comprising end walls and a front wall extending between said end walls, said end walls having guard-receiving passages therethrough and said front wall having means for pulling cables toward said guard and positioning said cables between said guard and said bow string, and means for holding said cables on a side of said guard away from said bow string, whereby the cables can be held selectively alternatively on either side of said guard with respect to said bow string said cable guard slide including a back wall, said back wall having a slit in it, and said guard slide being made of a material sufficiently resilient to permit the slit to be opened manually to admit the cables, and to close after the cables have passed through the slit.

13. In combination with a compound bow having a handle section and a pair of bow limbs, a bow string and a pair of cables extending between the outer end of the bow limbs in lateral spaced relationship with respect to the plane of the bow and bow string, and a cable guard comprising a rod connected at one end to said handle section and extending therefrom parallel to said plane and in outward spaced relationship with that side of said cables opposite said bow string to a free end beyond said cable when the bow is fully drawn, and a cable retaining means, slidably mounted on said rod, for holding intermediate portions of both said cables selectively either on the side of said rod contiguous said string or on the side of said rod opposite said string said cable holding means comprising two hollow rectangular open-sided box members each with a first split wall and a second, parallel wall in which a first cable-receiving channel extends perpendicular to the rod on an exterior side of said second wall and a second cable-receiving channel extends parallel to said first cable receiving channel in an interior side of said second wall.

14. The combination of claim 13 wherein the channeled wall of one of said members is spaced farther from said rod than the corresponding wall of the other of said members.

15. In combination with a compound bow having a handle section and a pair of bow limbs, a bow string and a pair of cables extending between the outer end of the bow limbs in lateral spaced relationship with respect to the plane of the bow and bow string, and a cable guard comprising a rod connected at one end to said handle section and extending therefrom parallel to said plane and in outward spaced relationship with that side of said cables opposite said bow string to a free end beyond said cable when the bow is fully drawn, and a cable retaining member slidably mounted on said rod, said retaining member having means for holding an intermediate portion of the length of said cables selectively either on the side of said rod contiguous said string or on the side of said rod opposite said string, said retaining member having through it a rod-receiving passage formed by walls defining at least in part a polygon.

* * * * *